US005504949A

United States Patent [19]

Yagi

[11] Patent Number: 5,504,949

[45] Date of Patent: Apr. 9, 1996

[54] POOL WALL STRUCTURE

[75] Inventor: Yoshinori Yagi, Tokyo, Japan

[73] Assignee: MIK Planning Inc, Tokyo, Japan

[21] Appl. No.: 335,571

[22] Filed: Nov. 7, 1994

[51] Int. Cl.[6] ..... E04H 1/14

[52] U.S. Cl. ..... 4/506; 4/513; 4/511; 482/55

[58] Field of Search ..... 4/488, 496, 504, 4/505, 506, 511, 512, 513, 904; 482/55, 41, 96, 148, 908

[56] References Cited

U.S. PATENT DOCUMENTS

| | | | |
|---|---|---|---|
| 1,091,798 | 3/1914 | Booraem et al. | 4/506 |
| 4,142,337 | 3/1979 | Holcomb | 4/506 X |
| 4,941,659 | 7/1990 | Silvestri | 4/511 X |
| 5,033,735 | 7/1991 | Erickson | 4/496 X |
| 5,306,217 | 4/1994 | Bracone | 4/496 |
| 5,353,446 | 10/1994 | Baranowski | 4/496 |

FOREIGN PATENT DOCUMENTS

| | | | |
|---|---|---|---|
| 3127173 | 1/1983 | Germany | 482/55 |

OTHER PUBLICATIONS

Thalasso Thérapie brochure, Undated, pp. 8 and 9.

Aix Marllioz brochure, Undated, p. 3.

*Primary Examiner*—Charles E. Phillips

*Attorney, Agent, or Firm*—Willian Brinks Hofer Gilson & Lione

[57] ABSTRACT

The present invention relates to a pool which permits movements such as complicated twisting of the legs and loins in stretching movements to be easily performed in water. The pool has a space surrounded by walls and a bottom and an irregular portion including recesses each having the form of an isosceles right-angled triangular prism, which are formed on a portion of the walls, and the projections formed between the respective adjacent recesses. The pool further has substantially horizontal handrails respectively provided at the upper ends of the recesses. Massage nozzles may also be provided in the walls of the recesses so as to spray streams of water.

6 Claims, 3 Drawing Sheets

POOL WALL STRUCTURE

BACKGROUND OF THE INVENTION

1. Field of the Invention

The present invention relates to a pool wall structure, and particularly to a pool wall structure provided with an irregular portion and handrails provided thereon so as to permit various stretching movements using the handrails.

2. Description of the Related Art

Since a pool is conventionally mainly used for swimming, the outer periphery of the conventional pool has a rectangular form, a circular form or the like for the purpose of swimming. The inner periphery of the pool also has curved or flat surfaces along the outer periphery having the above form.

The conventional pool is also used for purposes other then swimming. For example, by the use of the point that the buoyancy produced in water eliminates the need for a person in water to support the whole weight, and thus the application of loads to the legs and loins, walk training is carried out for rehabilitation of a long-stay patient in water.

Stretching movements are also conventionally performed for stretching specified muscles. The stretching movements in water permit an old man and long-stay patient which have the weak legs and loins to easily take free postures because no load is applied to the legs and loins due to the buoyancy. The stretching movements in water are thus excellent in respect to environment of the stretching movements.

However, since there is previously no idea of performing the stretching movements in water, the conventional pool has a wall structure which is unsuitable for effectively performing the stretching movements. Namely, since it is necessary for performing the stretching movements in water to maintain various postures by employing the buoyancy, handrails which a person holds with the hands are required for maintaining the postures.

The conventional pool has the handrails provided on a wall thereof. However, the conventional handrails are used for starting the backstroke, and are provided along a wall of the pool. In the stretching movement employing the backstroke starting handrails, the handrails can be held with the hands only at right angles with respect to the handrails, thereby causing the problem that movements such as complicated twisting of the legs and loins cannot be performed in the stretching movements.

SUMMARY OF THE INVENTION

An object of the present invention is to provide a pool wall structure which permits various stretching movements to easily be performed in water.

In order to achieve the object, in accordance with an embodiment of the present invention, a wall structure of a pool having a space filled with hot water or water and surrounded by walls and a bottom comprises an irregular portion which is formed by providing, on a portion of the pool walls, continuous recesses each having the form of an isosceles right-angled triangular prism, and which has the recesses and projections formed between the respective adjacent recesses; and substantially horizontal handrails respectively provided at the upper ends of the recesses, so that various stretching movements can easily be performed in water while holding the opposite handrails-with the hands.

In accordance with another embodiment of the present invention, a pool wall structure comprises various configurations of pool wall.

In accordance with another embodiment of the present invention, a pool wall structure comprises an island-like portion formed in a pool.

In accordance with a further embodiment of the present invention, a pool wall structure comprises nozzles which can spray high-pressure water for massage.

Since the present invention in which the irregular portion is formed on a portion of the walls of the pool by providing the continuous recesses each having the form of an isosceles right-angled triangular prism, and the substantially horizontal handrails are respectively provided at the upper ends of the recesses, in stretching movements in the pool, a person can enter one of the recesses formed on the wall of the pool and can easily hold the opposite handrails at substantially right angles with the hands while stretching the arms in two directions substantially at right angles. It is thus possible to maintain the body by the arms in the two directions and various natural postures in water. In stretching movements, therefore, movements such as complicated twisting of the legs and loins can easily be performed without loading the legs and lions due to the buoyancy.

An example of such stretching movements which can be performed by employing buoyancy without loading the legs and loins is a movement in which a person enters one of the recesses, stands face to the center of the pool, and holds the handrails with both hands, with the back in contact with the recess. In another movement, the handrails are held with the hands, and the body is relaxed and floated in water by virtue of buoyancy, with the head in contact with the vertex of the recess, so that, after movements, the person can be rested and mentally relaxed by maintaining a posture which can get rid of stress in mind and body.

DESCRIPTION OF THE PREFERRED EMBODIMENTS OF THE INVENTION

An embodiment of the present invention is described in detail below with reference to the attached drawings.

Figure 1:
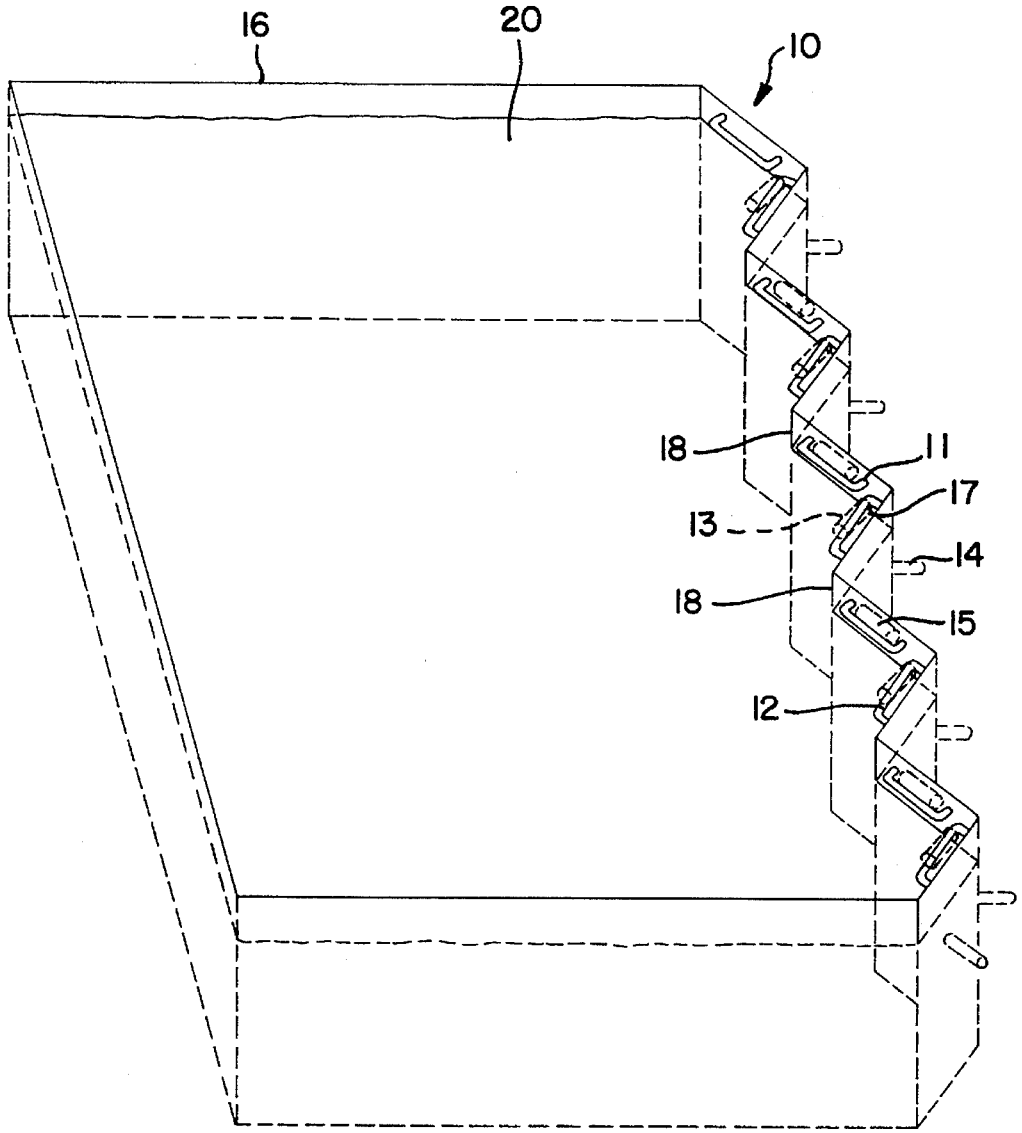
FIG. 1 is a perspective view illustrating a pool wall structure in accordance with a first embodiment of the present invention.
Figure 2:
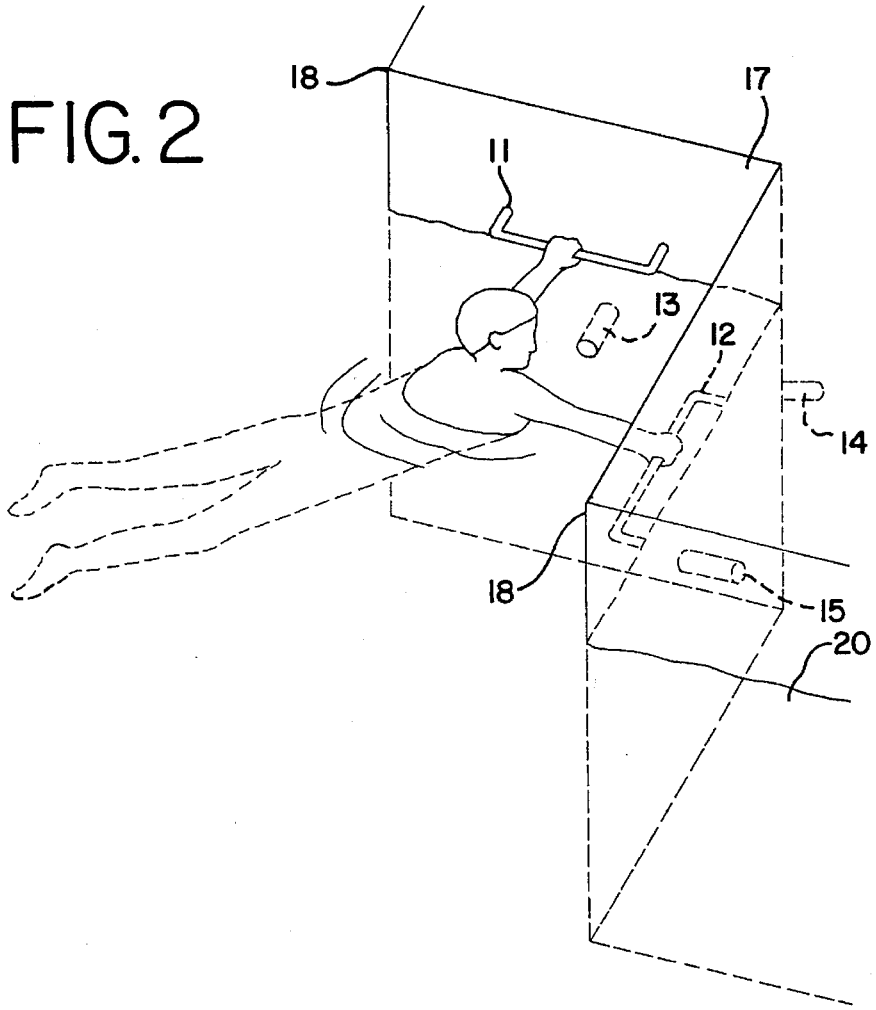
FIG. 2 is a perspective view illustrating a portion of the same pool wall structure.

This embodiment relates to a pool having a space surrounded by wall structure defining a perimeter line and a bottom, and filled with water or hot water, as shown in FIGS. 1 and 2.

In such a pool, recesses 17 each having the form of an isosceles right-angled triangular prism are continuously formed on a portion of the inner walls of a pool 16 having a rectangular outer periphery. This forms, in a portion of the inner walls, an irregular or saw-tooth-like portion 10 comprising the recesses 17 and projections 18 formed between the respective adjacent recesses 17. Substantially horizontal handrails 11 and 12 are respectively provided at the upper ends of the recesses 17 so that a person can enter one of the recesses 17 and perform various stretching movements.

In the wall structure of the pool 16 constructed as described above, a person can enter one of the recesses 17, stretch the arms in two directions at substantially right angles, and easily hold the opposite handrails 11 and 12 at substantially right angles with the hands. This permits the body to be held by the arms in the two directions in water, thereby maintaining various natural postures. It is thus possible to easily perform movements such as complicated twisting of the legs and loins in stretching movements.

When a person enters one of the recesses 17, stands face to the center of the pool 16 and holds the handrails 11 and 12 with the hands, with the back in contact with the recess 17, various stretching movements can be carried out by employing buoyancy without loading the legs and loins. A relaxation movement in which a person holds the handrails 11 and 12 with the hands, and is relaxed and floated by virtue of buoyancy, with the head in contact with the vertex of the recess 17 can rest and mentally relax the person by maintaining a posture which can get rid of stress in mind and body.

Further, in this embodiment, the formation of the recesses 17 on the inner walls of the pool 16 has the effect that when a person standing in one of the recesses 17 in the pool 16 is pulled up, another person standing on the pool side can set foot on the corresponding projection 18 so as to easily pull up the person standing in the recess 17.

Description will now be made of stretching movements employing the pool wall structure in accordance with the first embodiment of the present invention.

Figure 3A:
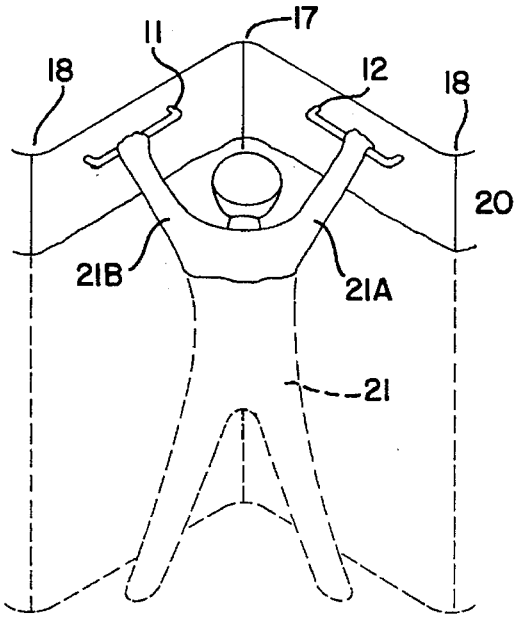
FIG. 3(*a*) is a perspective view illustrating a posture in stretching movements using the pool wall structure in accordance with the first embodiment of the present invention, and FIG. 3(*b*) is a perspective view illustrating another posture.
Figure 3B:
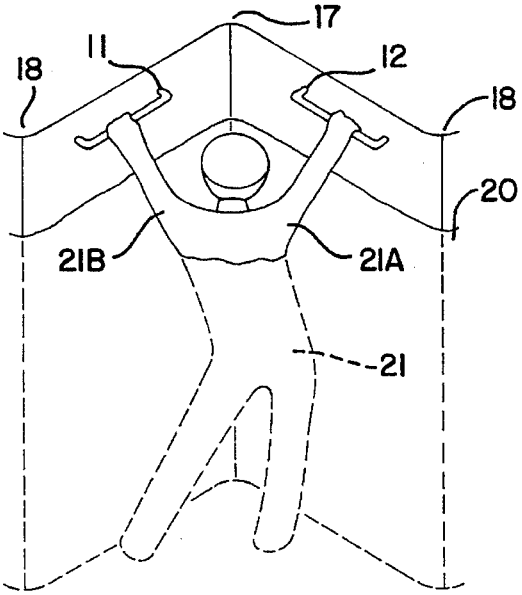

FIG. 3(*a*) is a perspective view illustrating a posture in the stretching movements employing the pool wall structure in accordance with the first embodiment of the present invention, and FIG. 3(*b*) is a perspective view illustrating another posture. The stretching movements relate to "lateral movement of the loins" in a gymnastic exercise program for a pain in the loins, which is established for overcoming the functional disorder of movement caused by a pain in the loins.

In the pool wall structure constructed as described above, a person 21 erectly stands face to the inner wall of the pool, as shown in FIG. 3(*a*). The legs are then spread out wider than the breadth of the shoulders, with the tiptoes in parallel, and the centers of the handrails 11 and 12 are lightly held with the hands 21B and 21A, respectively.

The person 21 then slowly laterally moves the loins for stretching the outer muscles on the sides of the body, as shown in FIG. 3(*b*). The loins are then slowly returned to the first position, and moved to the opposite side. These movements to the right and left are alternately performed.

Since these stretching movements can be performed in water, the movements can be preformed without loading the legs and loins. In addition, since the opposite handrails 11 and 12 can respectively be held by the hands 21A and 21B of the arms stretched in two directions at substantially right angles, the upper part of the body is fixed without movement, and the loins can easily be moved to the right and left. This can easily stretch the outer muscles on the sides of the body.

In another stretching movement employing the pool wall structure in accordance with this embodiment, a person enters one of the recesses 17 and stands face to the center of the pool, and the legs are stretched toward the center of the pool. Examples of such stretching movements include "water pushing", "underwater pedalling", "relaxation type A", "relaxation type B" and "relaxation type C". These stretching movements are briefly described below. In all of "water pushing", "underwater pedalling", "relaxation type A", "relaxation type B" and "relaxation type C", a person stands with the back toward the recess 17, and holds the handrails 11 and 12 with the hands, and the elbows are put on the handrails 11 and 12. The person then leans against the recess 17, with the neck and the back in close contact with the recess 17. This posture is a starting posture of the stretching movements.

In "water pushing", in the starting posture, the legs are put in order, and the knees are slowly pulled toward the breast while bending the legs. The legs are then obliquely forwardly stretched in such a manner that the soles of the feet is pushed into water. In this movement, the legs are alternately stretched without contacting the bottom of the pool. A strain is consciously applied to the abdominal muscle so as to relax the shoulders, with breathing in while bending the legs and breathing out while stretching the legs.

In "underwater pedalling", in the starting posture, the legs are put in order, and the knees are slowly pulled toward the breast while bending the legs. The legs are then alternately obliquely stretched forward like pedalling. In this movement, the legs are alternately stretched without contacting the bottom of the pool. A strain is consciously applied to the abdominal muscle so as to relax the shoulders, with rapidly breathing at changing the legs and breathing out while stretching the legs.

In "relaxation type A", in the starting posture, the legs are put in order, and stretched toward the center of the pool. The knees are then slightly bent, floated in water and slowly moved to the right and left. In this movement, the body is relaxed and left to the buoyancy with natural breathing.

In "relaxation type B", in the starting posture, the head and a part of the shoulders are put on the upper portion of the recess 17 of the pool, with the neck relaxed. The legs put in order are stretched in parallel with the bottom of the pool, and moved to the right and left close to the water surface of the pool. In this movement, the loins are maintained so as not to drop, with natural breathing.

In "relaxation type C", in the starting posture, the head is put on the upper portion of the recess 17 of the pool, with the neck relaxed. The legs put in order are stretched, and the whole body is floated by virtue of buoyancy in parallel with the bottom of the pool. The legs are then slowly sunk underwater while slowly breathing out. Then, the body is relaxed, left to the buoyancy and floated to the water surface while slowly breathing in.

In this way, the stretching movements such as "water pushing", "underwater pedalling", "relaxation type A", "relaxation type B" and "relaxation type C" can be carried out in water without loading the loins. Since the handrails 11 and 12 can be held by the hands, and the elbows can be put on the handrails 11 and 12, the upper half of the body can be fixed, thereby easily strengthening the abdominal muscle. This plays an important role in treatment of a pain of the loins in "water pushing" and "underwater pedalling in water". In the above "relaxation type A", "relaxation type B" and "relaxation type C", since the body can be relaxed and floated on the water surface by virtue of buoyancy, the body can be rested and mentally relaxed after movements, thereby getting rid of the stress in mind and body.

Figure 4:
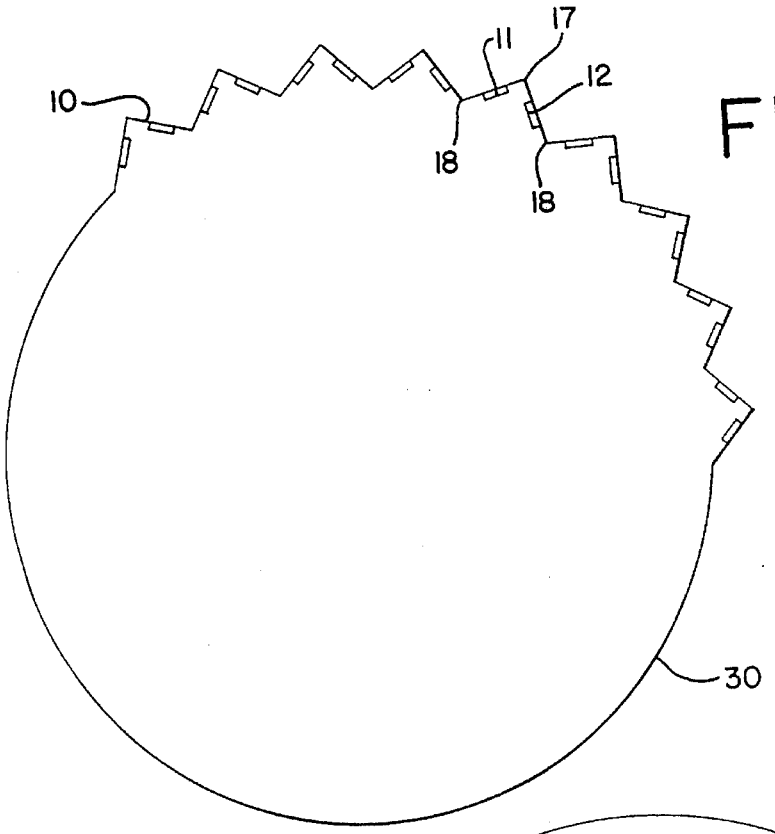
FIG. 4 is a plan view illustrating a pool wall structure in accordance with a second embodiment of the present invention.

FIG. 4 is a plan view illustrating a pool wall structure in accordance with a second embodiment of the present invention. In a pool 30 having a circular outer periphery, recesses 17 each having the form of an isosceles right-angled triangular prism are continuously provided on a portion of the inner walls thereof. This forms an irregular portion 10 comprising the recesses 17 and the projections 18 formed between the respective adjacent recesses 17 on a portion of the inner walls of the pool 30. Substantially horizontal handrails 11 and 12 are also respectively provided at the upper ends of the recesses 17.

The pool wall structure constructed as described above has the same effects as that obtained in the aforegoing first embodiment.

Figure 5:
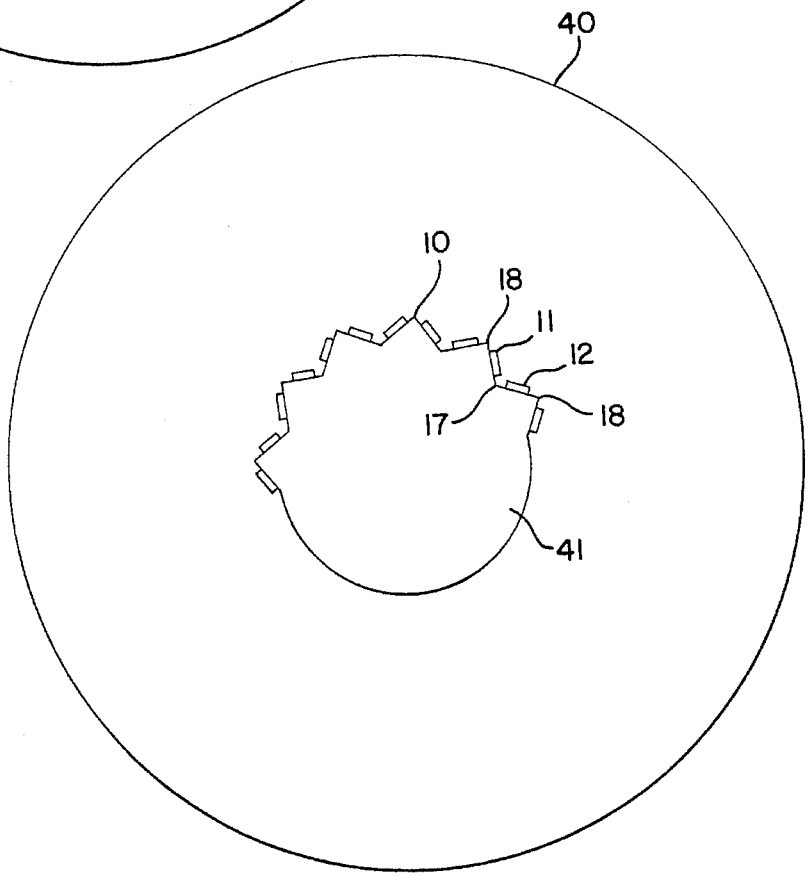
FIG. 5 is a plan view illustrating a pool wall structure in accordance with a third embodiment of the present invention.

FIG. 5 is a plan view illustrating a pool wall structure in accordance with a third embodiment of the present invention. In this embodiment, a floating island-like portion 41 having a circular outer periphery is formed at the center of a pool 40 having a circular outer periphery. In the floating island-like portion 41, recesses 17 each having the form of an isosceles right-angled triangular prism are continuously provided on a portion of the outer wall thereof. This forms an irregular portion 10 comprising the recesses 17 and the projections 18 formed between the respective adjacent recesses 17 on a portion of the outer wall thereof. Substantially horizontal handrails 11 and 12 are also respectively provided at the upper ends of the recesses 17.

The pool wall structure constructed as described above has the same effects as that obtained in the aforegoing first embodiment.

As a result of experiment performed by the applicant using a pool having the pool wall structure in accordance with the first embodiment of the present invention, the applicant could easily carry out various stretching movements in the recesses 17 of the pool 16, and obtain the same effects as those described above.

As illustrated in FIGS. 1 and 2, massage nozzles 13, 14 and 15 are provided in the walls of each of the recesses 17 so as to spray streams of water from the inner walls of the pool 16. Namely, the massage nozzle 14 is provided in the wall of the recess 17 at the vertex thereof, for example, at a height of 750 mm from the bottom of the pool, and the massage nozzles 13 and 15 are provided in the central portions of the opposite walls of the recess 17 at the same height as the massage nozzle 14.

When the massage nozzles 13, 14 and 15 are provided in the walls, as described above, the body of a person standing in the recess portion 17 can be sprayed with streams of water so that the muscles can be massaged. In the above "relaxation types A, B and C", the spray of streams of water on the body has the effects of massaging the muscles and of floating the body.

Although, in the above embodiments, the recesses 17 and the handrails 11 and 12 are formed on the inner wall of the pool having a rectangular or circular periphery, or the outer wall of the island-like portion, the form of the pool is not limited to this. The present invention can be applied to pools and island-like portions having other polygonal outer peripheries such as pentagonal and hexagonal outer peripheries, and any other desired forms which permit the formation of elliptical and cloud-formed pools and island-like portions. In this case, the same effects can be obtained.

Although, in the above embodiments, the recesses 17 and the handrails 11 and 12 are formed on a portion of the inner walls of the pool or the outer wall of the island-like portion 41, they are not limited to this. Even when the recesses and the handrails are formed over the whole periphery of the inner walls of the pool or the outer wall of the island-like portion 41, the same effects can be obtained.

Each of the embodiments of the present invention is illustrative and not restrictive. The scope of the present invention is defined by the appended claims, and all changes which fall within the claims are therefore intended to embraced by the claims.

What is claimed is:

1. A swimming pool having a bottom and a wall structure surrounding a space adapted to contain water, said wall structure defining a perimeter line, said wall structure comprising a saw tooth like portion which is formed by providing adjacent recesses each comprising a triangular prism portion recessed with respect to said perimeter line, and substantially horizontal handrails respectively provided in each recess, one on each of two sides of said prism portion.

2. A pool wall structure according to claim 1, wherein said walls are formed to have a rectangular form.

3. A pool wall structure according to claim 1, wherein said walls are formed to have a circular form.

4. A pool wall structure according to claim 1, wherein said walls are formed to have a polygonal form.

5. A pool wall structure according to claim 1, wherein an island-like portion is provided in said pool.

6. A pool wall structure according to claim 1, further comprising spray nozzles which are provided on inner walls of said pool so as to inwardly spray high-pressure streams of water.

* * * * *

UNITED STATES PATENT AND TRADEMARK OFFICE

CERTIFICATE OF CORRECTION

PATENT NO. : 5,504,949
DATED : April 9, 1996
INVENTOR(S) : Yoshinori Yagi

It is certified that error appears in the above-indentified patent and that said Letters Patent is hereby corrected as shown below:

On the Title Page item [73] "Assignee" information, after "Inc", insert --.-- .

In column 1, line 5, delete "1.".

In column 1, line 10, delete "2.".

In column 1, line 17, delete "then" and substitute --than--.

In column 1, line 66, delete "-".

In column 2, line 24, delete "lions" and subsitute --loins--.

UNITED STATES PATENT AND TRADEMARK OFFICE

CERTIFICATE OF CORRECTION

PATENT NO. : 5,504,949

DATED : April 9, 1996

INVENTOR(S) : Yoshinori Yagi

It is certified that error appears in the above-indentified patent and that said Letters Patent is hereby corrected as shown below:

In column 3, line 60, delete "preformed" and substitute --performed--.

In column 4, line 21, delete "is" and substitute --are--.

In column 5, line 33, after "of" insert --an--.

In column 6, line 25, after "to" insert --be--.

Signed and Sealed this

First Day of July, 1997

Bruce Lehman

*Attest:*

*Attesting Officer*

BRUCE LEHMAN

*Commissioner of Patents and Trademarks*